US009128458B2

(12) United States Patent
Park et al.

(10) Patent No.: US 9,128,458 B2
(45) Date of Patent: Sep. 8, 2015

(54) DEVELOPING UNIT TO EFFECTIVELY SUPPLY TONER TO DEVELOPING ROLLER AND IMAGE FORMING APPARATUS EMPLOYING SAME

(75) Inventors: Sung-min Park, Anyang-si (KR); Hyun-wook Bae, Yongin-si (KR); Jong-woo Lee, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1077 days.

(21) Appl. No.: 13/067,513

(22) Filed: Jun. 6, 2011

(65) Prior Publication Data

US 2012/0148314 A1 Jun. 14, 2012

(30) Foreign Application Priority Data

Dec. 9, 2010 (KR) ..... 10-2010-0125665

(51) Int. Cl.
*G03G 15/08* (2006.01)
*G03G 21/18* (2006.01)

(52) U.S. Cl.
CPC ..... *G03G 21/1814* (2013.01); *G03G 15/0865* (2013.01); *G03G 15/0868* (2013.01); *G03G 15/0877* (2013.01); *G03G 15/0891* (2013.01); *G03G 15/0834* (2013.01); *G03G 2215/0836* (2013.01); *G03G 2215/0844* (2013.01)

(58) Field of Classification Search
CPC ..... G03G 15/0834; G03G 2215/0844
USPC ..... 399/281, 279, 265
See application file for complete search history.

(56) References Cited

U.S. PATENT DOCUMENTS

| | | | | |
|---|---|---|---|---|
| 5,809,386 | A * | 9/1998 | Iwata | 399/281 |
| 6,343,201 | B1 * | 1/2002 | Wada et al. | 399/281 |
| 2003/0113139 | A1 * | 6/2003 | Yasukawa et al. | 399/281 |
| 2005/0084299 | A1 * | 4/2005 | Choi et al. | 399/281 |
| 2008/0205938 | A1 * | 8/2008 | Hirose | 399/254 |
| 2008/0247784 | A1 * | 10/2008 | Kakuta et al. | 399/263 |
| 2011/0103843 | A1 * | 5/2011 | Sato | 399/254 |
| 2011/0103844 | A1 * | 5/2011 | Sato | 399/262 |

FOREIGN PATENT DOCUMENTS

| | | |
|---|---|---|
| EP | 1318434 | 6/2003 |
| JP | 1999-0053816 | 7/1999 |
| JP | 2003-173084 | 6/2003 |
| JP | 2008-111998 | 5/2008 |

(Continued)

OTHER PUBLICATIONS

Patent Abstracts of Japan, Publication No. 2003-173084, Published Jun. 20, 2003.

(Continued)

*Primary Examiner* — David Gray
*Assistant Examiner* — Tyler Hardman
(74) *Attorney, Agent, or Firm* — Staas & Halsey LLP

(57) ABSTRACT

A developing unit includes a toner storage portion containing toner and a toner supply member, and a development portion disposed above the toner storage portion. A partition wall divides the toner storage portion from the development portion. The partition wall includes a supply opening that defines a toner supply path from the toner storage portion to the development portion, and a discharge opening that defines a toner discharge path from the development portion to the toner storage portion.

33 Claims, 8 Drawing Sheets

(56) References Cited

FOREIGN PATENT DOCUMENTS

| | | | |
|---|---|---|---|
| JP | 2008111998 A | * | 5/2008 |
| JP | 2008-170951 | | 7/2008 |

OTHER PUBLICATIONS

Patent Abstracts of Japan, Publication No. 2008-111998, Published May 15, 2008.

Korean Patent Abstracts, Publication No. 1999-0053816, Published Jul. 15, 1999.

European Patent Office Action, Mar. 22, 2012, Appln. No. 11172968.7.

Korean Patent Office Action, Apr. 27, 2012 in Appln. No. 2010-0125665.

Patent Abstracts of Japan, Publication No. 2008-170951, Published Jul. 24, 2008.

* cited by examiner

DEVELOPING UNIT TO EFFECTIVELY SUPPLY TONER TO DEVELOPING ROLLER AND IMAGE FORMING APPARATUS EMPLOYING SAME

CROSS-REFERENCE TO RELATED APPLICATIONS

This application claims the benefit of Korean Patent Application No. 10-2010-0125665, filed on Dec. 9, 2010, in the Korean Intellectual Property Office, the disclosure of which is incorporated herein in its entirety by reference.

BACKGROUND

1. Field

The present general inventive concept relates to a developing unit that is detachable from an image forming apparatus, and an image forming apparatus employing the developing unit.

2. Description of the Related Art

In electrophotographic image forming apparatuses, an electrostatic latent image is formed on a surface of a photosensitive body by scanning light that is modulated according to image information onto the photosensitive body, the electrostatic latent image is developed into a visible toner image by supplying toner to the electrostatic latent image, and the toner image is transferred to a recording medium and fused thereto so that an image is printed on the recording medium.

The electrophotographic image forming apparatuses include a developing unit containing a developer. A one-component developing unit contains toner as a developer, whereas a two-component developing unit contains toner and carrier as a developer. When all the developer contained in a developing unit is consumed, the developing unit is detached from an image forming apparatus and a new developing unit is installed in the image forming apparatus.

SUMMARY

The present general inventive concept provides a developing unit in which toner is effectively conveyed in the opposite direction to gravity and is supplied to a developing roller, and an electrophotographic image forming apparatus employing the developing unit.

According to an aspect, there is provided a developing unit including a toner storage portion containing toner and including a toner supply member, a development portion disposed above the toner storage portion and containing the toner supplied from the toner storage portion by the toner supply member and including a developing roller and a supply roller for supplying the toner to the developing roller, a partition wall dividing the toner storage portion and the development portion, wherein the partition wall includes a supply opening defining a toner supply path from the toner storage portion to the development portion, and a discharge opening defining a toner discharge path from the development portion to the toner storage portion.

The partition wall may include a lower partition wall that forms a lower wall of the development portion, and a side partition wall that extends upward from the lower partition wall and partitions the supply roller and the toner storage portion. The discharge opening may be provided in the lower partition wall, and the supply opening is provided in the side partition wall.

A lower end portion of the supply opening may be located above a lowest end portion of the circumference of the supply roller.

The development portion may include an auxiliary supply member that rotates facing the supply roller and conveys the toner supplied to the development portion through the supply opening to a region where the supply roller and the developing roller face each other.

The auxiliary supply member may be disposed at a downstream of the supply roller with respect to a rotation direction of the developing roller, and a center of the auxiliary supply member is located between a vertical straight line passing through a center of the developing roller and a vertical straight line passing through a center of the supply roller.

The discharge opening may be located at a lower portion of the auxiliary supply member.

The discharge opening may be located in a vertical projection of the auxiliary supply member.

An area of the discharge opening may be less than 50% of an area of the supply opening.

The supply opening and the discharge opening may extend along a length direction of the developing roller.

The toner supply member may include a rotation shaft and a wing portion connected to the shaft. The wing portion elastically may contact a wall portion defining the toner storage portion.

According to another aspect, there is provided a developing unit including a photosensitive body, a toner storage portion containing toner, a development portion including a developing roller for supplying the toner to an electrostatic latent image of the photosensitive body, and a supply roller for supplying the toner to the developing roller, a side partition wall dividing the toner storage portion and the development portion in a substantially horizontal direction and including a supply opening defining a toner supply path from the toner storage portion to the development portion, and a lower partition wall dividing the toner storage portion and the development portion in a substantially vertical direction and including a discharge opening defining a toner discharge path from the development portion to the toner storage portion.

The development portion may include an auxiliary supply member that rotates facing the supply roller and conveys the toner supplied to the development portion through the supply opening to a region where the supply roller and the developing roller face each other. The auxiliary supply member may be disposed at a downstream of the supply roller with respect to a rotation direction of the developing roller, and a center of the auxiliary supply member is located between a vertical straight line passing through a center of the developing roller and a vertical straight line passing through a center of the supply roller.

The lower partition wall may include a first lower partition wall corresponding to a lower portion of the auxiliary supply member, and a second lower partition wall connected to the first lower partition wall and the side partition wall and corresponding to a lower portion of the supply roller. The discharge opening may be provided in the first lower partition wall.

An area of the discharge opening may be less than 50% of an area of the supply opening.

The supply opening and the discharge opening may extend along a length direction of the developing roller.

The toner supply member may include a rotation shaft and a wing portion connected to the shaft. The wing portion elastically may contact a wall portion defining the toner storage portion.

According to another aspect, there is provided an electrophotographic image forming apparatus including a photosensitive body, an exposing unit for forming an electrostatic latent image on the photosensitive body, the developing unit described above, and a fusing unit for fusing a toner image transferred to a recording medium.

According to another aspect, there is provided a developing unit including a toner storage portion containing toner and a toner supply member, a development portion disposed above the toner storage portion and containing the toner supplied from the toner storage portion by the toner supply member, and a partition wall dividing the toner storage portion and the development portion, wherein the partition wall includes a discharge opening at a lower area of the development portion defining a toner discharge path from the development portion to the toner storage portion.

The developing unit may further include a supply opening formed in the partition wall spaced above the discharge opening.

An area of the discharge opening may be less than 50% of an area of the supply opening.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION

The present general inventive concept will now be described more fully with reference to the accompanying drawings, in which exemplary embodiments of the present general inventive concept are shown.

Figure 1:
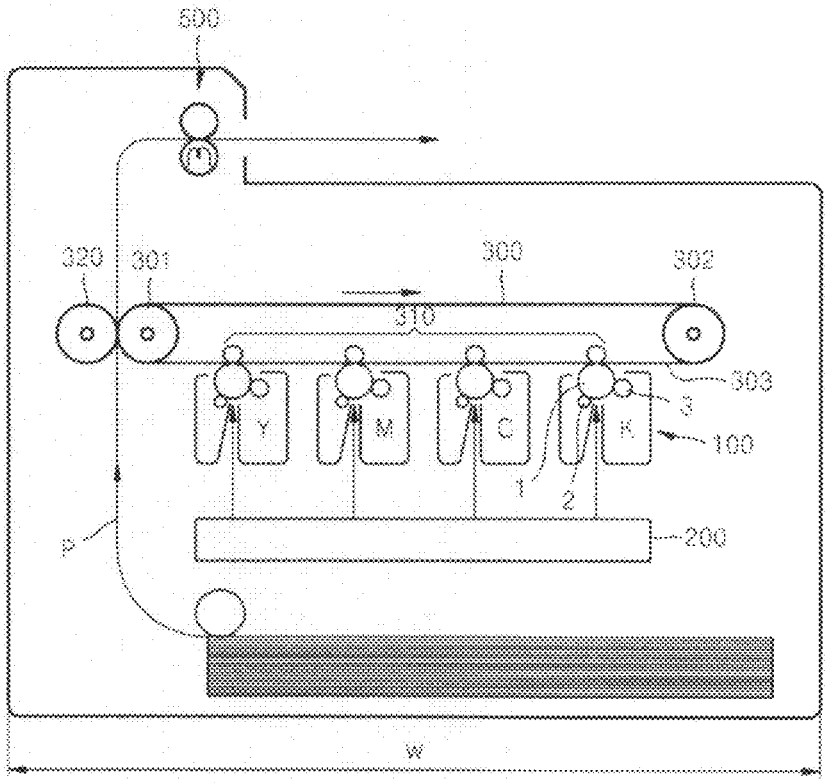
FIG. 1 illustrates a structure of an image forming apparatus according to an embodiment of the present invention.
Figure 2:
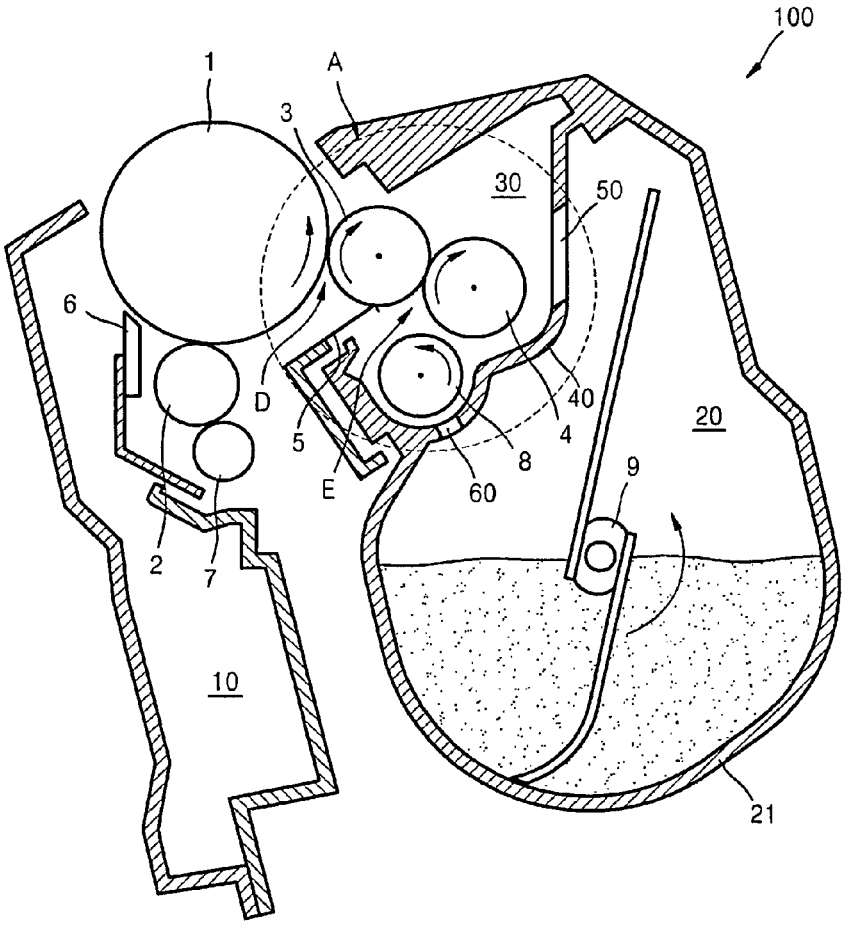
FIG. 2 illustrates a structure of a developing unit according to an embodiment of the present invention.

FIG. 1 illustrates a structure of an image forming apparatus according to an embodiment of the present invention. FIG. 2 illustrates a structure of a developing unit employed in the image forming apparatus of FIG. 1. The image forming apparatus according to the present embodiment is a color image forming apparatus for forming a color image with four developing units 100 respectively containing toners of cyan C, magenta M, yellow Y, and black K colors. The color image forming apparatus of FIG. 1 is referred to as a tandem-type color image forming apparatus. In the following descriptions, members used to form an image of cyan C, magenta M, yellow Y, and black K colors are indicated with suffixes of C, M, Y, and K at the end of reference numerals thereof.

Referring to FIG. 1, the image forming apparatus according to the present embodiment includes an intermediate transfer belt 300, an exposing unit 200, the four developing units 100, four intermediate transfer rollers 310, a final transfer roller 320, and a fusing unit 500.

The intermediate transfer belt 300 is an intermediate transfer medium to which a toner image is temporarily transferred before its final transfer to a recording medium P and circulates while being supported by support rollers 301 and 302. Each of the four developing units 100 includes a charge roller 2, a photosensitive drum 1, and developing roller 3. The photosensitive drum 1 is an example of the photosensitive body on which an electrostatic latent image is formed. The photosensitive drum 1 may include a photosensitive layer formed on an outer circumference of a circular metal pipe. The charge roller 2 is an example of a charger for charging a surface of the photosensitive drum 1 to a uniform electric potential. A corona charging unit may be employed instead of the charge roller 2. The exposing unit 200 scans light modulated according to image information onto the photosensitive drum 1 and thus an electrostatic latent image is formed on the photosensitive drum 1. A light emitting diode (LED)-type expositing unit for selectively emitting LED light according to image information via a plurality of LEDs arranged in a main scanning direction may be used as the exposing unit 200. Also, a laser scanning unit (LSU) for scanning light emitted by a laser diode onto the photosensitive drum 1 by deflecting the light in the main scanning direction with a light deflector may be used as the exposing unit 200. The developing roller 3 allows the toner contained in each of the four developing units 100 to adhere to the electrostatic latent image formed on the photosensitive drum 1, thereby forming a toner image.

The four developing units 100 are arranged such that the photosensitive drum 1 faces a lower surface 303 of the intermediate transfer belt 300. The photosensitive drum 1 may contact the lower surface 303 of the intermediate transfer belt 300. The intermediate transfer rollers 310 are an example of an intermediate transfer unit for transferring the toner image formed on the photosensitive drum 1 to the intermediate transfer belt 300. The four intermediate transfer rollers 310 are located facing the four photosensitive drums 1, with the intermediate transfer belt 300 interposed therebetween. An intermediate transfer bias voltage to transfer the toner image formed on the photosensitive drum 1 to the intermediate transfer belt 300 may be applied to the four intermediate transfer rollers 310. A corona transfer unit may be employed instead of each of the four intermediate transfer rollers 310.

The final transfer roller 320 is an example of a final transfer unit for transferring the toner image on the intermediate transfer belt 300 to the recording medium P. A final transfer bias voltage to transfer the toner image on the intermediate transfer belt 300 to the recording medium P may be applied to the final transfer roller 320. A corona transfer unit may be employed instead of the final transfer roller 320. The fusing unit 500 fuses the toner image transferred to the recording medium P by applying heat and pressure to the toner image.

A color image forming process of the above-described structure will be briefly described below.

First, according to image information of a black K color, the exposing unit 200 scans light onto the photosensitive drum 1K charged to a uniform electric potential by the charge roller 2K, thereby forming an electrostatic latent image. When a development bias is applied to the developing roller 3K of the developing unit 100K, black toner contained in the developing unit 100K adheres to the electrostatic latent image. A black toner image developed on the photosensitive drum 1K is transferred to the intermediate transfer belt 300 by an intermediate bias voltage applied to the intermediate transfer roller 310K. Toner images of cyan, magenta, and yellow colors are transferred to the intermediate transfer belt 300 through the same process and thus a color toner image is formed on the intermediate transfer belt 300. The color toner image is transferred to the recording medium P by a final transfer bias voltage applied to the final transfer roller 320. The color toner image is fused on the recording medium P by the fusing unit 500.

Heat generated by the fusing unit 500 may affect the photosensitive drum 1, the toner contained in the developing unit 100, and the exposing unit 200. Since the intermediate transfer belt 300 is interposed between the fusing unit 500, the developing unit 100, and the exposing unit 200 in the image forming apparatus configured as described above, the developing unit 100, the photosensitive drum 1, and the exposing unit 200 may be less affected by the heat of the fusing unit 500.

In order to increase the toner capacity of the developing unit 100, an internal volume of the developing unit 100 is increased. When the volume of the developing unit 100 is increased in a widthwise direction, the width W of the image forming apparatus is increased so that the footprint of the image forming apparatus is increased. Thus, to increase the toner capacity of the developing unit 100 without increasing the footprint of the image forming apparatus, the developing unit 100 may be increased in a vertical direction, that is, downwardly. In this case, the toner in the developing unit 100 is conveyed in the opposite direction to gravity to be supplied to the developing roller 3.

Figure 3:
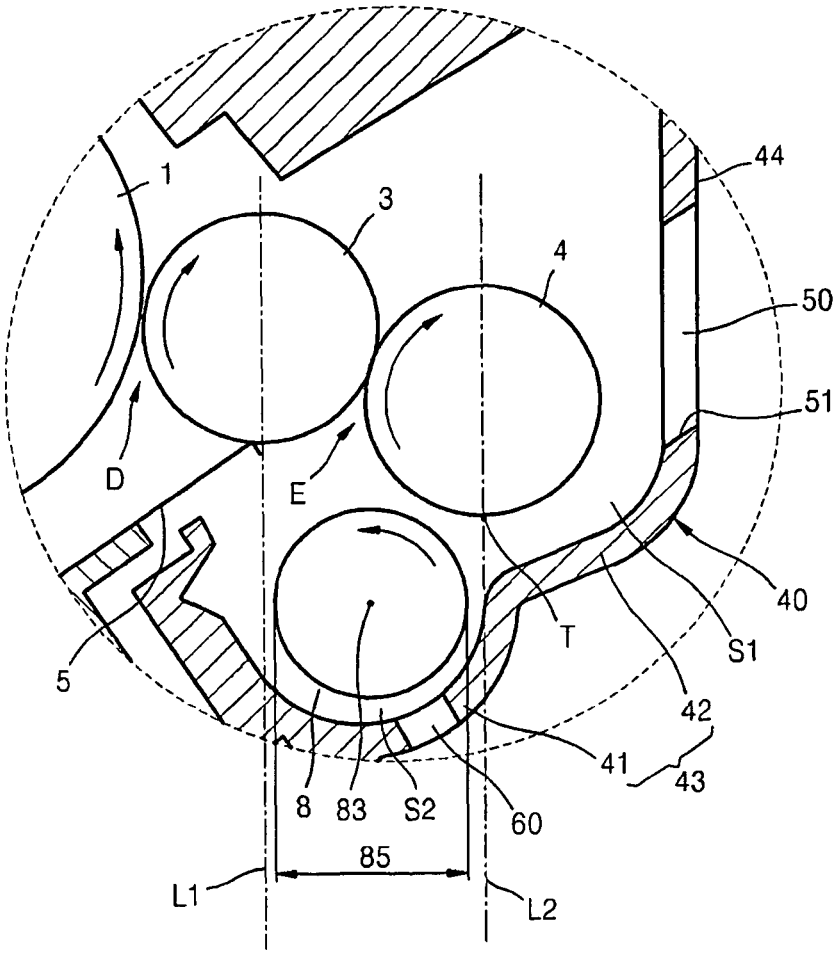
FIG. 3 is a detailed view of a portion A of FIG. 2.

FIG. 2 illustrates a detailed structure of the developing unit 100 of FIG. 1. FIG. 3 is a detailed view of a portion A of FIG. 2. Referring to FIGS. 2 and 3, a cleaning roller 7 is an example of a charge roller cleaning member for removing foreign materials adhered to an outer circumference of the charge roller 2. A cleaning member 6 removes residual toner and foreign materials from a surface of the photosensitive drum 1 before charging. The cleaning member 6 may be, for example, a cleaning blade having a leading end contacting the surface of the photosensitive drum 1. The residual toner and foreign materials removed from the photosensitive drum 1 may be stored in a waste toner containing unit 10.

The developing roller 3 is located facing the photosensitive drum 1. When a contact-type development method is employed, the developing roller 3 may rotate in contact with the photosensitive drum 1. When a non-contact-type development method is employed, the developing roller 3 is arranged separate from the photosensitive drum 1. The interval between the developing roller 3 and the photosensitive drum 1 may be set to be about several tens to several hundreds of microns. A supply roller 4 supplies toner to an outer circumferential surface of the developing roller 3.

A restriction member 5 restricts the amount of toner supplied to a development region D facing the photosensitive drum 1. For example, the restriction member 5 may be a restriction blade that elastically contacts the outer circumferential surface of the developing roller 3.

The developing unit 100 of the present embodiment includes a development portion 30 and a toner storage portion 20 defined by a wall portion 21. The development portion 30 is located above the toner storage portion 20. The development portion 30 and the toner storage portion 20 are divided in a vertical direction by a partition wall 40. A supply opening 50 for forming a path through which the toner may be supplied from the toner storage portion 20 to the development portion 30 is provided in the partition wall 40. A discharge opening 60 for forming a path through which the toner may be discharged from the development, portion 30 to the toner storage portion 20 is also provided in the partition wall 40. The supply opening 50 and the discharge opening 60 may extend in a length direction of the developing roller 3.

Figure 4:
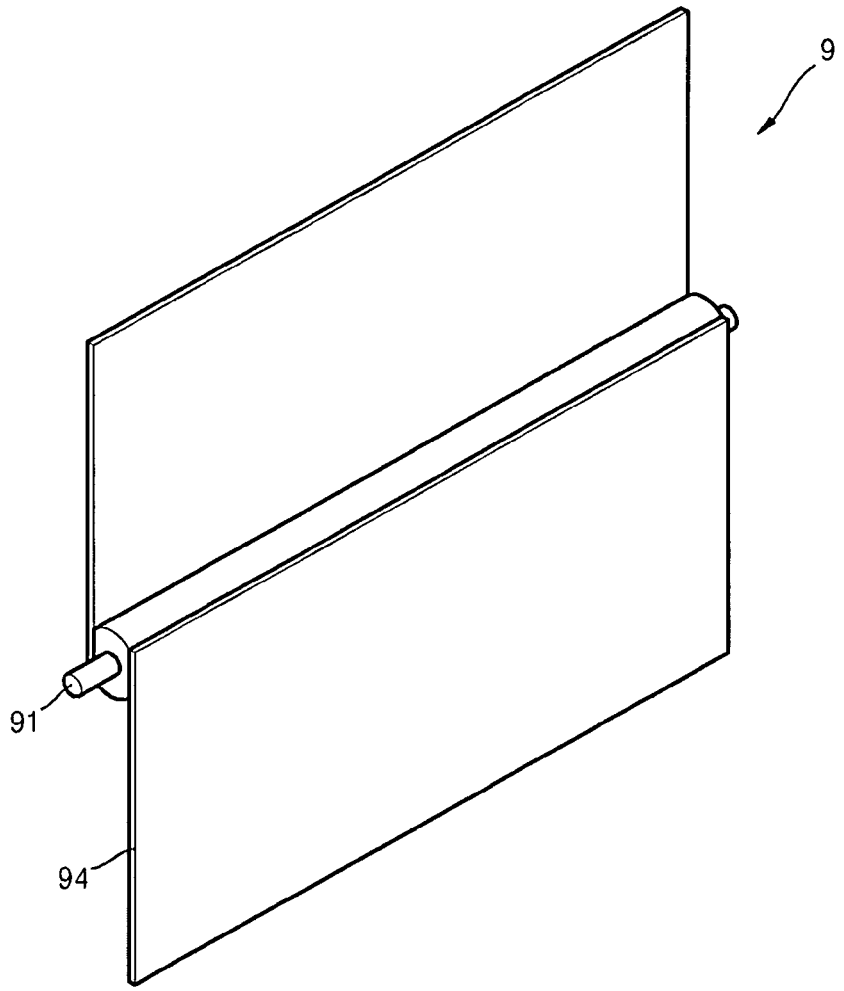
FIG. 4 is a perspective view of a toner supply member according to an embodiment of the present invention.

The toner is contained in the toner storage portion 20. A toner supply member 9 for supplying the contained toner to the development portion 30 is installed. The toner supply member 9 may include, for example, a rotation shaft 91 and a wing portion 94 formed on the rotation shaft 91 and having elasticity as shown in FIG. 4. When the toner supply member 9 rotates, the wing portion 94 elastically contacts the wall portion 21 forming the toner storage portion 20 and conveys toner to the development portion 30 through the supply opening 50. The toner supply member 9 is not limited thereto, and may have any shapes that may supply the toner to the development portion 30.

The developing roller 3 and the supply roller 4 are installed in the development portion 30. The supply roller 4 rotates in contact with the developing roller 3 or separately from the developing roller 3 with a predetermined interval. The supply roller 4 supplies the toner contained in the development portion 30 to the developing roller 3.

The toner supplied to the development portion 30 may be supplied by the supply roller 4, and thus to the developing roller 3, and may adhere to the outer circumferential surface of the developing roller 3. The supply roller 4 may be rotated in the same direction as the rotation direction of the developing roller 3. That is, the outer circumferential surface of the supply roller 4 and the outer circumferential surface of the developing roller 3 are moved in opposite directions in a region E where the supply roller 4 and the developing roller 3 face each other. Accordingly, with respect to the rotation direction of the developing roller 3, the toner remaining on the surface of the developing roller 3 after passing through a development region D is removed at the upstream side of the region E, and new toner may adhere to the surface of the developing roller 3 in the region E.

An auxiliary supply member 8 may be installed in the development portion 30. The auxiliary supply member 8 supplies toner that is supplied from the toner storage portion 20 to the development portion 30 to the region E where the supply roller 4 and the developing roller 3 face each other. The auxiliary supply member 8 is located downstream of the supply roller 4 with respect to the rotation direction of the developing roller 3. A rotation center 83 of the auxiliary supply member 8 is located between a vertical straight line L1 passing through the center of the developing roller 3 and a vertical straight line L2 passing through the center of the supply roller 4. The auxiliary supply member 8 facing the supply roller 4 rotates and supplies the toner to the region E. The auxiliary supply member 8 rotates in the opposite direction to the rotation direction of the supply roller 4. That is, in a region where the auxiliary supply member 8 and the supply roller 4 face each other, the direction in which the surface of the auxiliary supply member 8 moves is the same as the direction in which the surface of the supply roller 4 moves.

Figure 5:
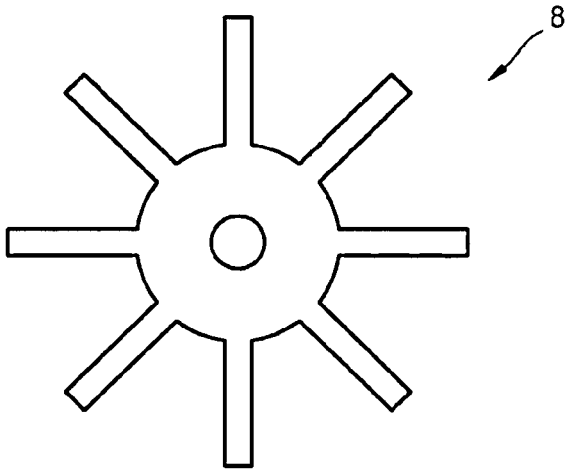
FIG. 5 is a side view of an auxiliary supply member according to an embodiment of the present invention.
Figure 6:
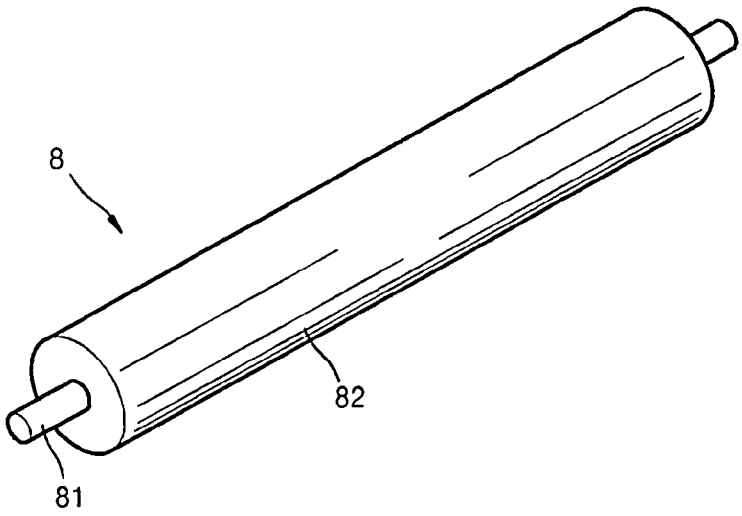
FIG. 6 is a perspective view of an auxiliary supply member according to another embodiment of the present invention.

The auxiliary supply member 8 may have, for example, a rotary paddle shape, as illustrated in FIG. 5. Also, as illustrated in FIG. 6, the auxiliary supply member 8 may have a roller shape formed of a metal material, a plastic material, or a rubber material. In this regard, the auxiliary supply member 8 includes a rotation shaft 81 and a roller portion 82 (see FIG. 6), wherein, the roller portion 82 may be formed of a plastic, metal, or rubber material. The roller portion 82 may have a porous structure such as sponge. Also, a surface of the roller portion 82 may have a surface roughness. The auxiliary supply member 8 may have any shape that may convey toner to the region E.

Toner is supplied from the toner storage portion 20 to the development portion 30 according to a rotation cycle of the toner supply member 9. When the wing portion 94 of the toner supply member 9 pushes the toner into the development portion 30 through the supply opening 50, a toner pressure is applied to the region E. When the wing portion 94 is out of the supply opening 50, the toner pressure in the region E may decrease, and a sufficient amount of toner may not adhere to the developing roller 3. As the auxiliary supply member 8 also applies a toner pressure to the region E, a sufficient amount of toner may be supplied to the developing roller 3.

Referring to FIGS. 2 and 3, the partition wall 40 may include a lower partition wall 43 that forms a lower wall of the development portion 30, and a side partition wall 44 that extends upward from the lower partition wall 43 and partitions the supply roller 4 and the toner storage portion 20. The development portion 30 and the toner storage portion 20 are partitioned by the lower partition wall 43 in a vertical direction and partitioned by the side partition wall 44 in a horizontal direction. The lower partition wall 43 may include a first lower partition wall 41 corresponding to a lower portion of the auxiliary supply member 8 and a second lower partition wall 42 connected to the first lower partition wall 41 and the side wall partition 44 and corresponding to a lower portion of the supply roller 4.

The supply opening 50 may be disposed in the side partition wall 44. A lower end portion 51 of the supply opening 50 is located above a lowest end portion T of the circumference of the supply roller 4. The toner supplied to the development portion 30 through the supply hole 50 drops in the lower partition wall 43, in more detail, a space 51 formed by the second lower partition wall 42 and the side wall partition 44. Thus, the toner that has been supplied to the development portion 30 does not drop to the toner storage portion 20 through the supply opening 50 and may be easily conveyed to the region E through the supply roller 4 and the auxiliary supply member 8.

The discharge opening 60 may be disposed in the lower partition wall 43. In order to prevent toner that is newly supplied to the development portion 30 through the supply opening 50 from dropping to the toner storage portion 20 through the discharge opening 60, the discharge opening 60 may be spaced apart from the supply opening 50 as far as possible. Also, the discharge opening 60 may be necessarily located so as to easily discharge toner discharged from the region E through a space S2 between the first lower partition wall 41 and the auxiliary supply member 8 as the auxiliary supply member 8 rotates. In this connection, the discharge opening 60 may be disposed near a lower portion of the auxiliary supply member 8, i.e., in the first side partition wall 41. For example, the discharge opening 60 may be located in a vertical projection region 85 of the auxiliary supply member 8.

The toner supplied to the development portion 30 through the supply opening 50 is supplied to the region E by using the supply roller 4 and the auxiliary supply member 8 and is conveyed to a development region D by using the developing roller 3. Some of the toner contained in the region E is conveyed to the space S2 between the first lower partition wall 41 and the auxiliary supply member 8 and drops to the toner storage portion 20 through the discharge opening 60. In this manner, the toner may circulate in order of the toner storage portion 20, the supply opening 50, the development portion 30, the discharge opening 60, and back to the toner storage portion 20.

If an amount (a supply amount) of the toner supplied to the development portion 30 through the supply opening 50 is more than an amount (a development amount) used by the photosensitive drum 1 in the developing region D, for example, when a low density image or a low coverage image is printed, an amount of the toner collected by the toner storage portion 20 through the discharge opening 60 increases. When a high density image or a high coverage image is printed, the amount of the collected toner is reduced. Thus, the amount of toner in the region E remains constant, and a sufficient amount of toner may be uniformly supplied to the developing roller 3. Further, factors which may deteriorate image quality, such as stagnation of the toner in the development portion 30, deterioration of toner property due to the stagnation, and an excessive charge, etc., may be reduced.

If the discharge opening 60 has an extremely large size, an excessive amount of the toner may move from the development portion 30 to the toner storage portion 20. To set an appropriate size of the discharge opening 60, a ratio of good image quality may be determined by testing image quality with respect to a ratio of an area of the supply opening 50 and an area of the discharge opening 60. A test may be conducted by, for example, consecutively printing solid images and confirming whether the printed solid images are defective, i.e. whether densities of the printed solid images are reduced. According to the test, if the ratio of the area of the supply opening 50 and the area of the discharge opening 60 exceeds about 50%, an insufficient amount of toner is supplied to the developing region D and thus it is confirmed to be defective that densities of the printed solid images are reduced. Therefore, the ratio of the area of the supply opening 50 and the area of the discharge opening 60 may not exceed about 50%. For example, the ratio of the area of the supply opening 50 and the area of the discharge opening 60 may be set between about 10% and about 50%.

Figure 8:
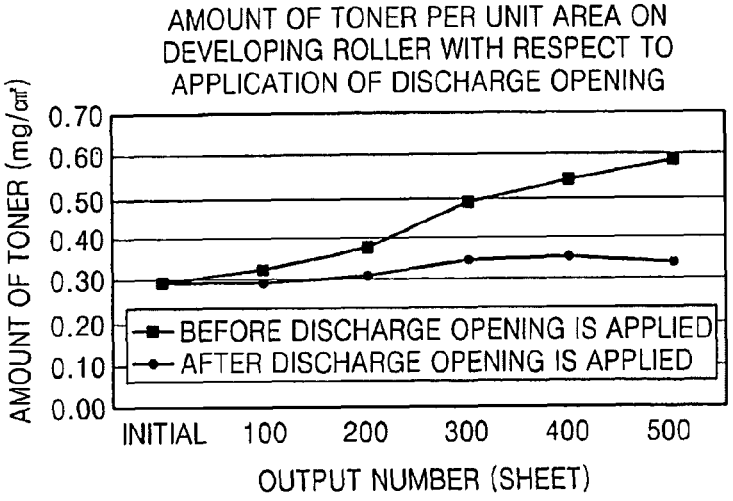
FIG. 8 is a graph of a result obtained by measuring an amount of toner per unit area of a surface of a developing roller 3.
Figure 9:
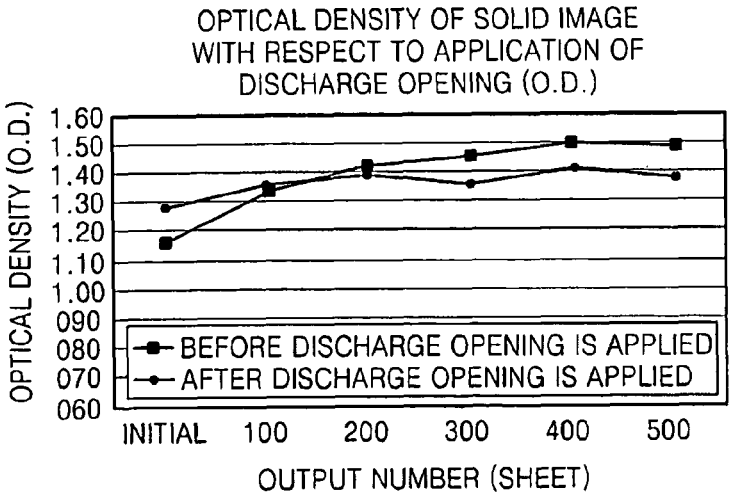
FIG. 9 is a graph of a result obtained by measuring an optical density when a solid image is printed.
Figure 10:
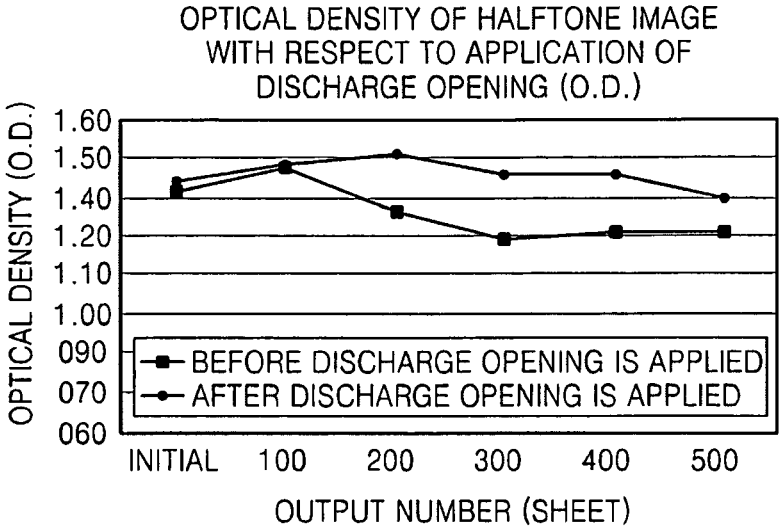
FIG. 10 is a graph of a result obtained by measuring an optical density when a halftone image is printed.

FIGS. 8 through 10 are graphs of a result obtained by measuring an amount (B1, mg/cm$^2$) of toner per unit area of a surface of the developing roller 3 after printing an image having coverage of about 1% by 500 sheets and printing the image in a 100 sheet unit again, a result obtained by measuring an optical density (B2, O.D) when a solid image is printed, and a result obtained by measuring an optical density (B3, O.D.) when a halftone image is printed, respectively. Table 1 shows the measurement results of FIGS. 8 through 10.

TABLE 1

| Output Number (sheet) | | initial | 100 | 200 | 300 | 400 | 500 |
|---|---|---|---|---|---|---|---|
| Before discharge opening is applied | B1 | 0.29 | 0.33 | 0.38 | 0.49 | 0.54 | 0.59 |
| | B2 | 1.15 | 1.34 | 1.42 | 1.45 | 1.50 | 1.48 |
| | B3 | 0.31 | 0.34 | 0.28 | 0.25 | 0.26 | 0.25 |
| After discharge opening is applied | B1 | 0.28 | 0.30 | 0.31 | 0.35 | 0.36 | 0.34 |
| | B2 | 1.27 | 1.36 | 1.39 | 1.36 | 1.41 | 1.38 |
| | B3 | 0.32 | 0.34 | 0.36 | 0.33 | 0.33 | 0.30 |

Referring to Table 1 and FIGS. 8 through 10, when the discharge opening 60 is used, changes in an amount of toner remaining on the surface of the developing roller 3, the optical density of the solid image, and the optical density of the halftone image are smaller than when the discharge opening 60 is not used, which means that a toner pressure remains constant in the region E of the development portion 30 by using the discharge opening 60.

Figure 7:
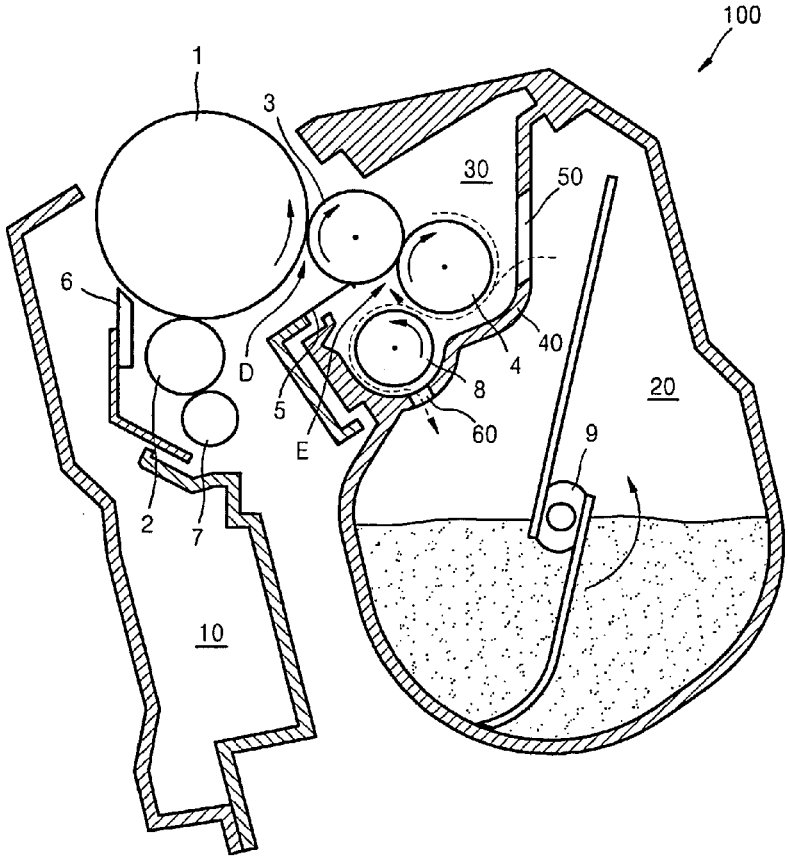
FIG. 7 illustrates a toner circulation process in the developing unit of FIG. 2, according to an embodiment of the present invention.

In accordance with the above-described structure, as shown in FIG. 7, the toner supplied from the toner storage portion 20 to the development portion 30 through the supply opening 50 is conveyed to the region E between the auxiliary supply member 8 and the supply roller 4 and applies a toner pressure to the region E. The toner of the region E is adhered to the developing roller 3. The toner adhered to the developing roller 3 is restricted to have a uniform thickness by the restriction member 5 and is supplied to the developing region D. The toner that is supplied to the development portion 30 and is not used to develop is continuously stagnant in the development portion 30, which may deteriorate performance of the toner. The toner pressure is necessarily maintained constant in the region E in order to supply a uniform and sufficient amount of toner to the developing region D. The more the amount of stagnant toner increases, the higher the toner pressure increases in the region E. In this case, a stress increasingly is applied to the toner in the region E, which causes deterioration of toner property, an excessive charge of toner, etc., leading to deterioration in development performance. The discharge opening 60 is provided in the developing unit 100 to discharge toner from the development portion 30 to the toner storage portion 20 so that toner that is excessively supplied is discharged from the region E through a gap between the auxiliary supply member 8 and the partition wall 40 and is collected to the toner storage portion 20 through the discharge opening 60. Toner removed from the developing roller 3 by the supply roller 4 at the upstream of the region E is supplied to the region E again or is collected to the toner storage portion 20 through the discharge opening 60. Thus, an appropriate toner pressure is always maintained in the region E. The toner removed from the region E is mixed with the toner in the toner storage portion 20 and supplied to the development portion 30. As the toner circulates as described above, the toner may be effectively supplied to the developing roller 3 in the opposite direction to gravity. Further, the toner is prevented from being stagnant in the development portion 30 and thus deteriorations in toner property, an excessive charge, and development performance are also prevented. Also, since the toner may be uniformly and stably supplied to the developing roller 3, uniformity in the quality of an image may be obtained.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A developing unit comprising:

a toner storage portion containing toner and comprising a toner supply member;

a development portion disposed above the toner storage portion and containing the toner supplied from the toner storage portion by the toner supply member, and including a developing roller and a supply roller for supplying the toner to the developing roller; and a partition wall dividing the toner storage portion and the development portion, wherein the partition wall includes a supply opening defining a toner supply path from the toner storage portion to the development portion, and a discharge opening defining a toner discharge path from the development portion to the toner storage portion, wherein the development portion further includes an auxiliary supply member that rotates facing the supply roller and conveys the toner supplied to the development portion through the supply opening to a region where the supply roller and the developing roller face each other, wherein a lower end portion of the supply opening is located above a lowest end portion of the circumference of the supply roller, wherein the supply opening is located directly adjacent the supply roller, and wherein the discharge opening is located directly adjacent the auxiliary supply member.

2. The developing unit of claim 1, wherein the partition wall comprises a lower partition wall that forms a lower wall of the development portion, and a side partition wall that extends upward from the lower partition wall and partitions the supply roller and the toner storage portion, wherein the discharge opening is provided in the lower partition wall, and the supply opening is provided in the side partition wall.

3. The developing unit of claim 1, wherein the auxiliary supply member is disposed at a downstream of the supply roller with respect to a rotation direction of the developing roller, and a center of the auxiliary supply member is located between a vertical straight line passing through a center of the developing roller and a vertical straight line passing through a center of the supply roller.

4. The developing unit of claim 3, wherein the discharge opening is located at a lower portion of the auxiliary supply member.

5. The developing unit of claim 4, wherein the discharge opening is located in a vertical projection of the auxiliary supply member.

6. The developing unit of claim 4, wherein an area of the discharge opening is less than 50% of an area of the supply opening.

7. The developing unit as recited in claim 1, wherein the supply opening and the discharge opening extend along a length direction of the developing roller.

8. The developing unit as recited in claim 1, wherein the toner supply member includes a rotation shaft and a wing portion connected to the shaft.

9. The developing unit as recited in claim 8, wherein the wing portion elastically contacts a wall portion defining the toner storage portion.

10. A developing unit comprising:

a photosensitive body;

a toner storage portion containing toner;

a development portion including a developing roller for supplying the toner to an electrostatic latent image of the photosensitive body, and a supply roller for supplying the toner to the developing roller;

a side partition wall dividing the toner storage portion and the development portion in a substantially horizontal direction and including a supply opening defining a toner supply path from the toner storage portion to the development portion; and a lower partition wall dividing the toner storage portion and the development portion in a substantially vertical direction and including a discharge opening defining a toner discharge path from the development portion to the toner storage portion, wherein the development portion further includes an auxiliary supply member that rotates facing the supply roller and conveys the toner supplied to the development portion through the supply opening to a region where the supply roller and the developing roller face each other, wherein a lower end portion of the supply opening is located above a lowest end portion of the circumference of the supply roller, wherein the supply opening is located directly adjacent the supply roller, and wherein the discharge opening is located directly adjacent the auxiliary supply member.

11. The developing unit of claim 10, wherein the auxiliary supply member is disposed at a downstream of the supply roller with respect to a rotation direction of the developing roller, and a center of the auxiliary supply member is located between a vertical straight line passing through a center of the developing roller and a vertical straight line passing through a center of the supply roller.

12. The developing unit of claim 11, wherein the lower partition wall comprises a first lower partition wall corresponding to a lower portion of the auxiliary supply member, and a second lower partition wall connected to the first lower partition wall and the side partition wall and corresponding to a lower portion of the supply roller, wherein the discharge opening is provided in the first lower partition wall.

13. The developing unit of claim 12, wherein an area of the discharge opening is less than 50% of an area of the supply opening.

14. The developing unit as recited in claim 10, wherein the supply opening and the discharge opening extend along a length direction of the developing roller.

15. The developing unit as recited in claim 10, wherein the toner supply member includes a rotation shaft and a wing portion connected to the shaft.

16. The developing unit as recited in claim 15, wherein the wing portion elastically contacts a wall portion defining the toner storage portion.

17. An electrophotographic image forming apparatus comprising:

a photosensitive body;

an exposing unit for forming an electrostatic latent image on the photosensitive body;

a developing unit as recited in claim 1 for developing the electrostatic latent image by supplying toner to the electrostatic latent image; and a fusing unit for fusing a toner image transferred to a recording medium.

18. The electrophotographic image forming apparatus of claim 17, wherein the partition wall comprises a lower partition wall that forms a lower wall of the development portion, and a side partition wall that extends upward from the lower partition wall and partitions the supply roller and the toner storage portion, wherein the discharge opening is provided in the lower partition wall, and the supply opening is provided in the side partition wall.

19. The electrophotographic image forming apparatus of claim 18, wherein the auxiliary supply member is disposed at a downstream of the supply roller with respect to a rotation direction of the developing roller, and a center of the auxiliary supply member is located between a vertical straight line passing through a center of the developing roller and a vertical straight line passing through a center of the supply roller.

20. The electrophotographic image forming apparatus of claim 19, wherein the lower partition wall comprises a first lower partition wall corresponding to a lower portion of the auxiliary supply member, and a second lower partition wall connected to the first lower partition wall and the side partition wall and corresponding to a lower portion of the supply roller, wherein the discharge opening is provided in the first lower partition wall.

21. The electrophotographic image forming apparatus of claim 20, wherein the discharge opening is located in a vertical projection of the auxiliary supply member.

22. The electrophotographic image forming apparatus of claim 19, wherein an area of the discharge opening is less than 50% of an area of the supply opening.

23. A developing unit comprising:

a toner storage portion containing toner and comprising a toner supply member;

a development portion disposed above the toner storage portion and containing the toner supplied from the toner storage portion by the toner supply member, and including a developing roller and a supply roller for supplying the toner to the developing roller; and a partition wall dividing the toner storage portion and the development portion, wherein the partition wall includes a supply opening defining a toner supply path from the toner storage portion to the development portion, and a discharge opening defining a toner discharge path from the development portion to the toner storage portion, wherein the development portion comprises an auxiliary supply member that rotates facing the supply roller and conveys the toner supplied to the development portion through the supply opening to a region where the supply roller and the developing roller face each other, wherein a lower end portion of the supply opening is located above a lowest end portion of the circumference of the supply roller, and wherein the auxiliary supply member is disposed at a downstream of the supply roller with respect to a rotation direction of the developing roller, and a center of the auxiliary supply member is located between a vertical straight line passing through a center of the developing roller and a vertical straight line passing through a center of the supply roller.

24. The developing unit of claim 23, wherein the discharge opening is located at a lower portion of the auxiliary supply member.

25. The developing unit of claim 24, wherein the discharge opening is located in a vertical projection of the auxiliary supply member.

26. The developing unit of claim 24, wherein an area of the discharge opening is less than 50% of an area of the supply opening.

27. A developing unit comprising:

a photosensitive body;

a toner storage portion containing toner;

a development portion including a developing roller for supplying the toner to an electrostatic latent image of the photosensitive body, and a supply roller for supplying the toner to the developing roller;

a side partition wall dividing the toner storage portion and the development portion in a substantially horizontal direction and including a supply opening defining a toner supply path from the toner storage portion to the development portion; and a lower partition wall dividing the toner storage portion and the development portion in a substantially vertical direction and including a discharge opening defining a toner discharge path from the development portion to the toner storage portion, wherein the development portion comprises an auxiliary supply member that rotates facing the supply roller and conveys the toner supplied to the development portion through the supply opening to a region where the supply roller and the developing roller face each other, wherein a lower end portion of the supply opening is located above a lowest end portion of the circumference of the supply roller, and wherein the auxiliary supply member is disposed at a downstream of the supply roller with respect to a rotation direction of the developing roller, and a center of the auxiliary supply member is located between a vertical straight line passing through a center of the developing roller and a vertical straight line passing through a center of the supply roller.

28. The developing unit of claim 27, wherein the lower partition wall comprises a first lower partition wall corresponding to a lower portion of the auxiliary supply member, and a second lower partition wall connected to the first lower partition wall and the side partition wall and corresponding to a lower portion of the supply roller, wherein the discharge opening is provided in the first lower partition wall.

29. The developing unit of claim 28, wherein an area of the discharge opening is less than 50% of an area of the supply opening.

30. An electrophotographic image forming apparatus comprising:

a photosensitive body;

an exposing unit for forming an electrostatic latent image on the photosensitive body;

a developing unit as recited in claim 1 for developing the electrostatic latent image by supplying toner to the electrostatic latent image; and a fusing unit for fusing a toner image transferred to a recording medium, wherein the partition wall comprises a lower partition wall that forms a lower wall of the development portion, and a side partition wall that extends upward from the lower partition wall and partitions the supply roller and the toner storage portion, wherein the discharge opening is provided in the lower partition wall, and the supply opening is provided in the side partition wall, and wherein the auxiliary supply member is disposed at a downstream of the supply roller with respect to a rotation direction of the developing roller, and a center of the auxiliary supply member is located between a vertical straight line passing through a center of the developing roller and a vertical straight line passing through a center of the supply roller.

31. The electrophotographic image forming apparatus of claim 30, wherein the lower partition wall comprises a first lower partition wall corresponding to a lower portion of the auxiliary supply member, and a second lower partition wall connected to the first lower partition wall and the side partition wall and corresponding to a lower portion of the supply roller, and wherein the discharge opening is provided in the first lower partition wall.

32. The electrophotographic image forming apparatus of claim 31, wherein the discharge opening is located in a vertical projection of the auxiliary supply member.

33. The electrophotographic image forming apparatus of claim 30, wherein an area of the discharge opening is less than 50% of an area of the supply opening.

* * * * *